US005121516A

United States Patent [19]

Jones

[11] Patent Number: 5,121,516

[45] Date of Patent: Jun. 16, 1992

[54] APPLIANCES FOR USE WITH BEDS

[76] Inventor: Paul G. Jones, Heron Hill, Breinton Common, Hereford HR4 87PP, United Kingdom

[21] Appl. No.: 623,793

[22] PCT Filed: Jun. 28, 1989

[86] PCT No.: PCT/GB89/00722

§ 371 Date: Dec. 19, 1990

§ 102(e) Date: Dec. 19, 1990

[87] PCT Pub. No.: WO90/00020

PCT Pub. Date: Jan. 11, 1990

[30] Foreign Application Priority Data

Jul. 1, 1988 [GB] United Kingdom ..... 8815711-0

[51] Int. Cl.[5] ..... A47C 31/00

[52] U.S. Cl. ..... 5/658; 5/53.1; 5/131; 5/662; 5/929

[58] Field of Search ..... 5/53.1, 181, 183-185, 5/280, 202, 443, 445, 503, 507, 508, 512, 131, 132, 305, 431, 444; 272/900

[56] References Cited

U.S. PATENT DOCUMENTS

| | | | |
|---|---|---|---|
| 2,666,213 | 1/1954 | Bash | 5/183 |
| 2,740,133 | 4/1956 | Fox | 5/184 X |
| 3,621,497 | 11/1971 | Fitzgerald | 5/280 X |
| 3,626,524 | 12/1971 | Minton | 5/444 |
| 3,893,197 | 7/1975 | Ricke | 5/444 |
| 3,967,334 | 7/1976 | Ricke et al. | 5/444 |
| 4,104,751 | 8/1978 | Churchman | 5/444 X |

FOREIGN PATENT DOCUMENTS

| | | | |
|---|---|---|---|
| 3608142 | 9/1987 | Fed. Rep. of Germany . | |
| 846878 | 8/1960 | United Kingdom | 5/53.1 |
| 1435693 | 5/1976 | United Kingdom | 5/53.1 |
| 1466080 | 3/1977 | United Kingdom . | |

*Primary Examiner*—Michael F. Trettel
*Attorney, Agent, or Firm*—Bauer & Schaffer

[57] ABSTRACT

A first part fixable on a bed and a footboard with two depending legs carried by the first part. The position of the footboard is adjustable relative to the first part enabling its height to be varied. The first part is a framework having two subframes each with a pair of elongate members supported in parallel one with the other. The elongate members have upstanding members on their outer ends and two bolt members interconnect cross members of the subframes and are adjustable to move the subframes relative to one another to cause the upstanding portions to bear against and clamp the framework to the lower part of a bed. The upstanding portions of one subframe are adapted to receive legs. Alternatively, the first part is formed as one or two metal plates fixable to the outside of the foot end of the bed base with two further metal plates on the inner surface of the foot end of the bed base.

18 Claims, 5 Drawing Sheets

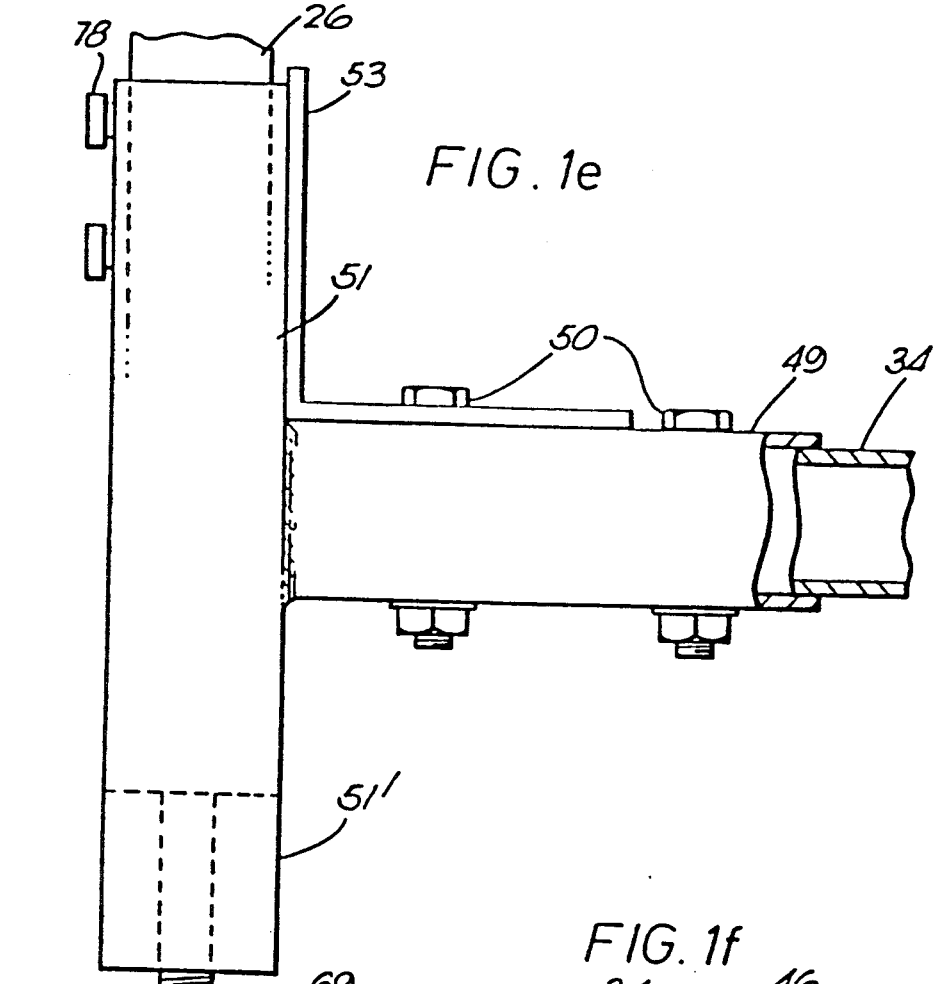
FIG. 1e
FIG. 1f
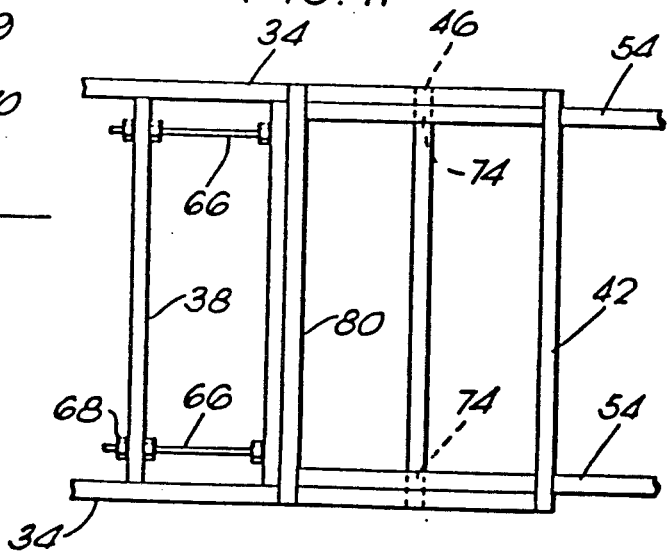

APPLIANCES FOR USE WITH BEDS

TECHNICAL FIELD

The invention concerns appliances for use with beds, in particular appliances for aiding couples having sexual intercourse on a bed.

BACKGROUND ART

Traditionally beds have been made with wooden or metal frames comprising two vertical members at the head and foot ends of the bed respectively with a support surface extending therebetween upon which a mattress is located. The vertical members comprise legs upon which the bed stands and upstanding head and footboards respectively against which a person in the bed may lean or bear a foot, e.g. when engaged in sexual intercourse.

At present the majority of beds sold are of the "divan" style—that is to say having a covered sprung base part upon which a mattress is laid and without a solid footboard.

The sides and ends of the divan bed bases known to us are usually provided at least partially with (covered) boarding or other means for supporting the sides of the mattress and decorative headboards—and less usually footboards—may be mounted on this boarding. However, to our knowledge neither the boarding of the bed bases, nor the decorative footboards sometimes provided, are strong enough to be used by a person in the manner described bearing a foot when engaged in sexual intercourse.

An object of the invention is the provision of an appliance overcoming this disadvantage of the beds presently available. Other objects of the invention include the provision of such an appliance which is readily adaptable to different widths, lengths and heights of beds and which may be, if desired, readily removed from the bed, disassembled and stored.

DISCLOSURE OF THE INVENTION

In one aspect the invention provides an appliance for use with a bed of the type having a base part supporting a mattress to aid couples having sexual intercourse on the bed, the appliance comprising a first part releasably fixable to the base of the bed and which in use is below the plane of the upper surface of the base part and is adapted to receive a second part of the appliance upstanding therefrom, the second part having a portion adapted in use to lie adjacent the foot end of the mattress of the bed such that a foot of a person on the bed mattress may bear against it.

The second part may comprise a padded footboard having two leg members depending therefrom which are received in the first part, and the relative positions of the first part and the footboard of the second part of the appliance may be adjustable to enable the height of the footboard above the said first part to be varied.

The first part may comprise a framework releasably fixable to the bed, the leg members of the second part being supported by the framework in a position such that the upper edge of the footboard is slightly above the plane of the upper surface of a mattress on the bed.

In one embodiment the framework comprises one or more elements in use located beneath and fixed to the bed and having means for bearing in use upon a floor upon which the bed stands.

The relative positions of the elements forming the framework desirably are adjustable and have means enabling them to be fixed in their adjusted positions so that the appliance may be clamped to beds of different widths and/or lengths.

With advantage the framework is provided with means for bearing upon a floor upon which a bed to which the appliance is attached stands, said means being adjustable in height so that the appliance may be adapted for use with beds the bases of which stand at different heights above a floor on which they are located.

In one particular form the framework comprises two subframes, each including a pair of elongate members supported in parallel one with the other and spaced apart by cross members, first ends of the elongate members of the said two subframes being provided with upstanding members which in use overlie a lower part of a bed to which the appliance is to be attached; at least one bolt member interconnecting cross members of the two subframes and which is adjustable in length to move the two subframes relative to one another to a position in which the said upstanding members of the said two subframes bear against said lower part of a bed with which the appliance is to be used so as to clamp the appliance to the bed, and wherein the upstanding members of one said subframe are further adapted to receive said leg members of the said second part of the appliance and have feet the height of which may be adjusted to bear upon a floor upon which in use the bed to which the appliance is attached stands.

In this form the spacing of the elongate members of the said two subframes is desirably such that second ends of the elongate members of one said subframe lie in the plane of and between second ends of the elongate members of the other said subframe and between a pair of cross members attached thereto. Again, the first ends of the elongate members of the said other subframe with advantage have feet the height of which may be adjusted to bear upon a floor upon which in use the bed to which the appliance is attached stands.

The second ends of the elongate members of the one or other of the said subframes may carry spacer members which may be adjusted to bear against an undersurface of a bed to which the appliance is attached.

It is preferred that the elongate members and the cross members are of metal and of hollow square section, wherein the elongate members of the first subframe are supported parallel and spaced apart by a first and second cross members attached to and extending between facing surfaces of the elongate members adjacent the said first ends thereof and partway along their lengths, third and fourth cross members attached to upper and lower surfaces of and extending above above and below the elongate members at the said second ends thereof and a fifth cross member attached to and extending between facing surfaces of the elongate members at a location partway along their lengths, wherein the elongate members of the second subframe are supported parallel and spaced apart by a first cross member attached to and extending between facing surfaces of the elongate elongate members adjacent the said second ends thereof and by a second cross member attached to and extending across the said first ends thereof, and wherein a pair of bolt members are provided coupling the said second cross member of the first subframe and the said second cross member of the second subframe.

The first subframe may be provided with a further cross member attached to upper surfaces and extending above the elongate members at a location partway along the length of the elongate members between the said second and third cross members thereof.

In another form the framework includes a pair of elongate members supported in parallel one with the other and spaced apart by a number of cross members, first ends of the elongate members of the said two subframes having upstanding portions which in use overlie a lower part of the head end of a bed to which the appliance is to be attached and which are adapted to receive leg members of the said second part of the appliance and have feet the height of which may be adjusted to bear upon a floor upon which in use the bed to which the appliance is attached stands, wherein each cross member comprises a centre part attached to each of the elongate members and end sections of smaller diameter than the said centre part which are received within the centre part such that the positions of the end sections relative to the centre sections are adjustable telescopically, wherein fixing means are provided enabling the end sections and centre parts to be releasably fixed together after their relative positions have been adjusted such that the outermost ends of the cross members are aligned with the sides of the bed, and wherein each cross member carries at its outermost end means enabling the framework to be releasably clamped to the sides of the bed to which the appliance is to be attached.

In this form the outermost end of each end part of each cross member may carry an upstanding plate member which overlies a lower part of a bed with which the appliance is to be used, and which is used to clamp the framework to the bed by adjustment of the relative positions of the centre parts and sections of smaller diameter and the fixing means.

Alternatively the outermost end of each end part of each cross member may carry an upstanding clamp member which may be arranged to grip and clamp onto either side of boards forming the sides of the base of the bed.

Another embodiment of the invention provides that the framework comprises a metal plate fixable to the outer surface of the foot end of the base of the bed having on its outermost surface two or more hollow metal parts fixed thereto each of which receives a leg member of the second part of the appliance, clamp means being provided to enable fixture of the legs members when the height of the footboard has been placed in a desired position.

If the appliance is for use with a bed which is in two separable sections, the framework preferably comprises two metal plates fixable to the outer surface of the foot end of the base of each section of the bed and having on its outermost surface a hollow metal part fixed thereto which receives a leg member of the second part of the appliance, clamp means being provided to enable fixture of the legs members when the height of the footboard has been placed in a desired position.

Desirably the elements of the framework are welded together.

With the second noted embodiment of the invention there may be provided on the inner surface of the foot end of the base of the bed the a second metal plate in register with and fixable to or each first said metal plate, such that the or each pair of metal plates act to clamp the the foot end of the base of the bed therebetween.

The above and other aspects features and advantages of the invention will become apparent from the following description of various embodiments of the invention now made with reference to the accompanying drawings in which:

MODES FOR CARRYING OUT THE INVENTION

Figure 1A:
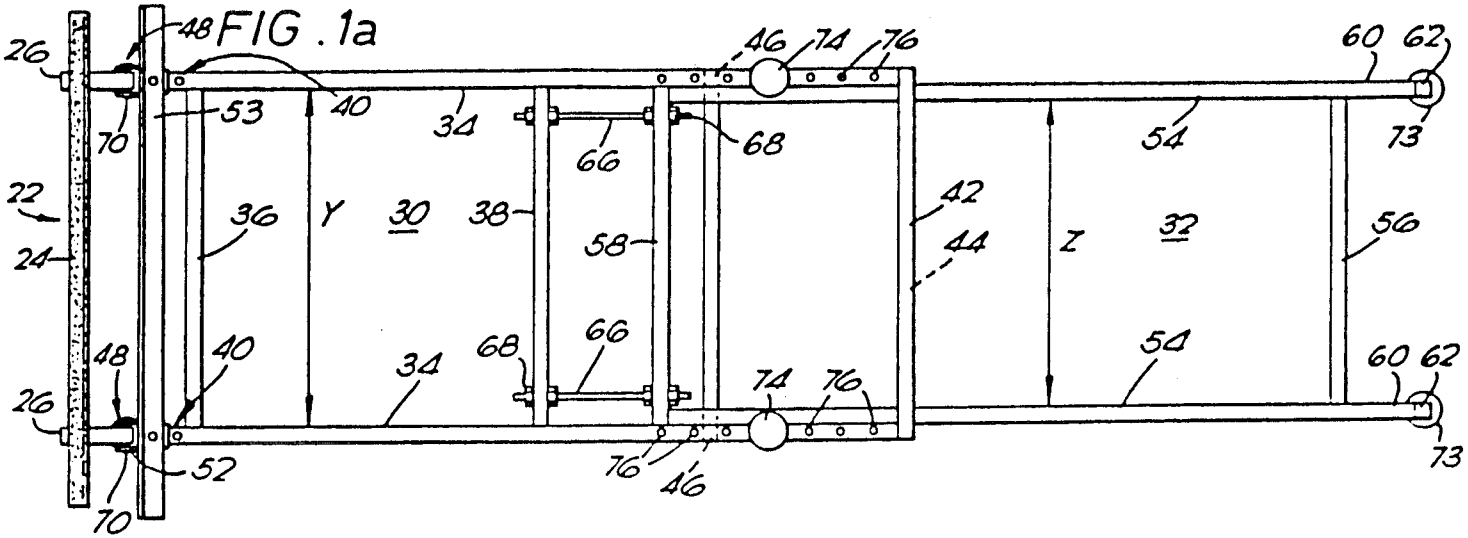
FIG. 1 schematically shows at A, B and C respectively plan, side and end views of a first embodiment of the invention, at D a detailed view to an enlarged scale of part of the appliance and at F and E scrap views of modified forms of this embodiment, FIG. 2 schematically shows at A, B and C respectively plan, side and end views of a second embodiment of the invention, FIG. 3 schematically shows at A and B face and side views of a third embodiment of the invention and at C a face view of a modified form of this embodiment of the invention.
Figure 1B:
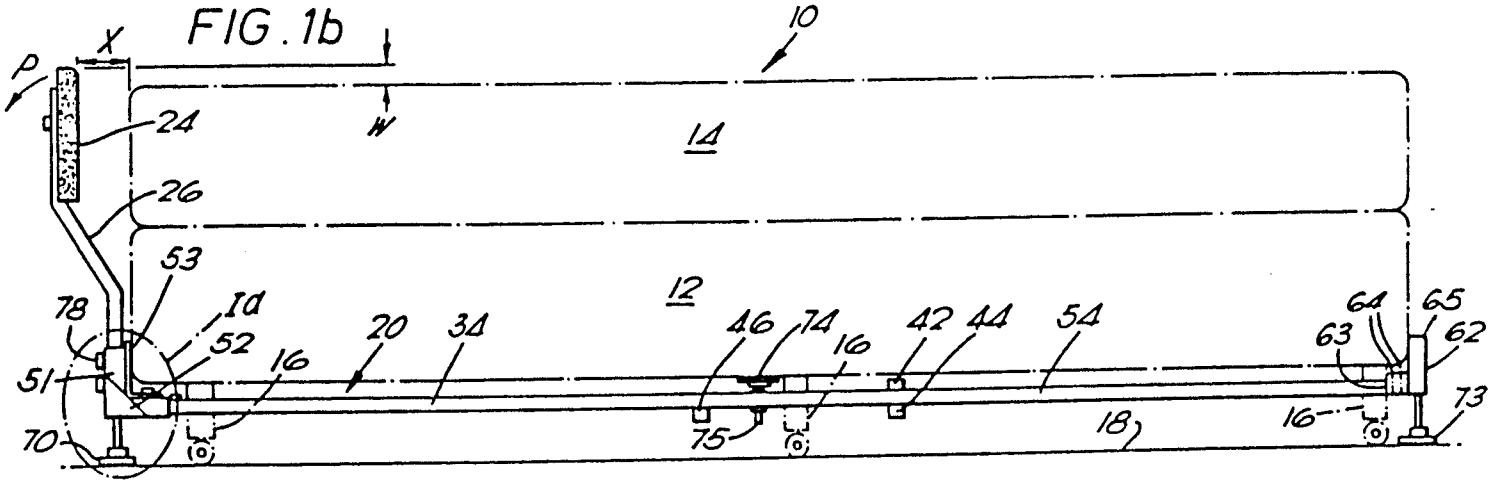
Figure 1C:
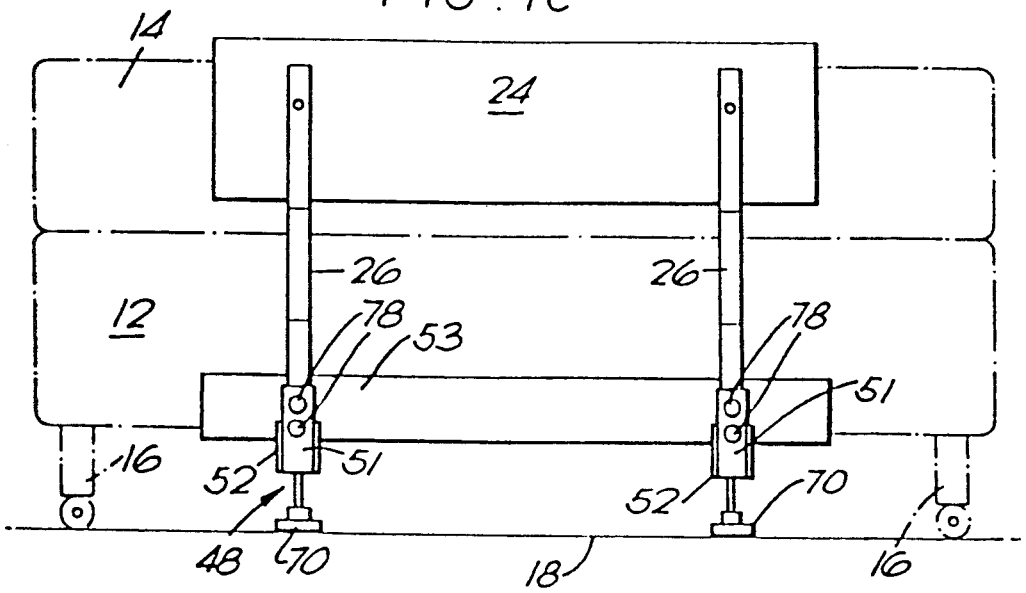

FIG. 1 shows (at B and C) in dotted outline a bed 10 to which the appliance embodying the invention is attached. The bed comprises a base 12 supporting a mattress 14 and is itself supported by feet 16 on a floor shown at 18.

The appliance comprises a first part 20 fixed to the bed and a second part 22 supported and carried by the first part 20 and upstanding from that part. The second part 22 includes a padded footboard 24 having two square section hollow mild steel leg members 26 depending therefrom. The leg members 26 are cranked as shown such that the padded footboard 24 is spaced a distance X from the foot end 30 of the mattress 14.

The first part 20 of the appliance comprises a framework formed from two linked subframes 30 and 32.

Subframe 30 is formed of a pair of square section hollow mild steel elongate members 34 supported in parallel one with the other and spaced apart a distance Y by three square section hollow mild steel cross members.

The elongate members 34 are held rigidly parallel to one another and spaced apart by the five cross members which are welded to each of the elongate members 34 as shown. First and second cross member 36 and 38 are welded to facing surfaces of the elongate members 34 and extend between those members adjacent first ends 40 thereof(cross member 36) and partway along the length of members 34 (cross member 38). Third and fourth cross members 42 and 44 are welded—one above the other—to the upper and lower surfaces of the elongate members 34 and extend across those members at the ends thereof spaced from the first ends 40 whilst the fifth cross member 46 is welded to lower surfaces of the elongate members 34 and extends between those members at a location partway along their length.

The first ends 40 (see detailed view FIG. 1D) of the elongate members 34 carry generally L-shaped member 48 which are of square section hollow and of mild steel and are of larger dimensions that the members 34. The horizontal (as viewed in the Figures) leg 49 of each member 48 receives an end of a member 34 and the two are fixed together by bolts 50 such that the other leg 51 of the member 48 is substantially vertically disposed (as shown) and overlies a lower part of the foot end 30 of the base 12 of the bed to which the appliance is attached.

The legs 49 and 51 of the member 48 welded together and additional support for the member is provided by a pair of flanges 52 welded to the sides of the legs 49 and 51 as shown. As shown in FIGS. 1A to 1D the members 48 are interconnected by a mild steel load spreading member 53 which is L-shaped in section and held clamped in position on the members 48 by the rearmost bolts 50 holding those members on the ends of the elongate members 34. Load spreading member 53 extends, in use, parallel to the base of the bed and bears against the foot end of the bed.

The second subframe 32 is formed of a pair of square section hollow mild steel elongate members 54 supported in parallel one with the other and spaced apart a distance Z by two square section hollow mild steel cross members 56 and 58.

The elongate members 54 are held rigidly parallel to one another and spaced apart by the two cross members welded to each of the elongate members 54 as shown. The first cross member 56 is welded to facing surfaces of the elongate members 54 and extends between those members adjacent first ends 60 thereof whilst the second cross member 58 as shown is welded across the ends of the elongate members 54 spaced from the ends 60 thereof.

The first ends 60 of the elongate members 54 each carry a generally L-shaped member 62—similar to the members 48 on the first ends of the members 34. The horizontal (as viewed in the Figures) leg 63 of each member 62 receives an end of a member 54 and the two are fixed together by bolts 64 such that the other leg 65 of the member 48 is substantially vertically disposed (as shown) and overlies a lower part of the foot end 30 of the base 12 of the bed to which the appliance is attached. The legs 63 and 65 of the member 62 are welded together.

A pair of threaded bolt members 66 are provided extending through apertures in the cross members 38 and 58 as shown and the relative positions of the two subframes 30 and 32 may be adjusted by suitably tightening or slackening nuts 68 provided on the ends of the bolt members 66.

Subframe 30 is provided with a pair of adjustable feet 69 having foot members 70 depending from the first ends of the elongate members 34 to the floor 18. The coupling of the members 70 to the subframe 30 is of known form (see detailed view in FIG. 1D) the foot members 69—having threaded stems threadably engaging plastics insert members 71 carried in the lower ends of the vertically disposed leg 51 of the members 48. The members 70 desirably have the form shown in FIG. 1D—that is to say with a concave centre section 72—the better to hold the appliance against movement on a carpeted floor.

Subframe 32 is provided with a pair of adjustable feet 73 of the same form as the feet 69 and will not further be described.

By suitable adjustment of the feet 69 and 73 spacing of the framework above the floor 18 may be varied.

It will be noted that the spacing Z of the elongate members 54 is less than the spacing Y of the elongate members 34 by an amount equal to twice the thickness of the elongate members so that in the assembled condition shown the "inner" ends of the members 54 lie just within the "inner" ends of the elongate members 34—the elongate members 34 and 54 lying substantially in the same plane.

Between the cross members 38 and 42 the elongate members 34 of the first subframe 30 carry adjustable spacer members 74 of known form (similar to the adjustable feet 69 and 73) having threaded stems 75 which may be engaged in a selected one of a series of threaded apertures 76 formed in the elongate members 34 as shown. The height of the members 74 above the elongate members 34 may be adjusted such that these members bear against the undersurface of the base 12 of the bed 10.

To assemble the appliance and attach it to the bed 10 a user first removes the mattress from the base of the bed and turns the bed base 12 upside down. The user then places the parts 48 and 62 on the ends of the elongate members 34 and 54 and fixes them in position with the bolts 50 and 63. Thereafter the user places the subframes 30 and 32 on the upturned bottom of the bed base 12—passing the elongate members 54 of subframe 32 between the cross members 42 and 44 of the subframe 30—with the legs 51 and 65 spaced slightly from the foot and head ends of the bed respectively.

The ends of the bolt members 66 are threaded through the apertures in cross members 38 and 58 and the nuts 68 placed on their ends tightened sufficiently for the subframes to interlock with one another generally parallel to the bottom of the bed base 12. The spacer members 74 are engaged in a suitable one of the apertures 76 such they underlie a cross member of the bed base 12.

The lengths of the spacer members 74 are then adjusted to position the interlocked subframes parallel and close to the the bottom of the bed base 12 such that a substantial part and of the the legs 51 and 65 of the members 48 and 62 overlie the bottom of base 12 of at the foot and head ends of the bed 10.

Thereafter the nuts 68 are tightened further on bolt members 66 to pull the two subframes towards one another—and cause the load spreading member 53 on legs 51 and legs 65 to bear against and grip the ends of the base 12 of the bed.

For use with particular types of bed having a strong construction the load spreading plate 53 carried on the legs 51 may be omitted altogether or replaced by separate short plates which bear only on a part of the foot end of the bed adjacent the members 48. If desired or thought necessary similar load spreading members may be provided carried by the members 62 on the head end of the bed.

The adjustable feet 69 and 73 are thereafter adjusted to bring the parts thereof intended to bear on the floor 18 into the plane of the lowermost part of the feet 16 of the bed.

Thereafter the bed is turned right side up such that it is supported on its feet 16 and the adjustable feet 69 and 73 of the appliance and the mattress 14 replaced on the bed base 12.

The leg members 26 are then inserted in the upper ends of the hollow legs 51 and 65 of the members 48 and 62 and the height of the padded footboard 24 adjusted to bring its upper edge a distance W—approximately 7.5 cm (3") above the upper surface of mattress 14. The leg members 26 are held in that position by pairs of screw clamp members 78 carried by the legs 51 and 65 as shown and which are tightened up when the footboard reaches the desired height.

It will be appreciated that the appliance formed and assembled as described enables a person to place his foot against the padded footboard 24 and to bear thereagainst when engaged in sexual intercourse.

It will be appreciated that the appliance is firmly attached to the bed 10 and that when pressure is applied to the padded footboard 24—generally in the direction of arrow P—their will be a tendency for the "inner" end of the subframe 30 to lift which is resisted by the actions of tensioned bolt members 66, the cross member 42 and 46 and the adjustable spacers 74.

In order to accommodate different bed constructions —in particular beds which stand at different heights above the floor 18—it is envisaged that a number of threaded stems 75 will be provided of different lengths—a user selecting an appropriate length of stem 75 when assembling the appliance on a bed.

Figure 1D:
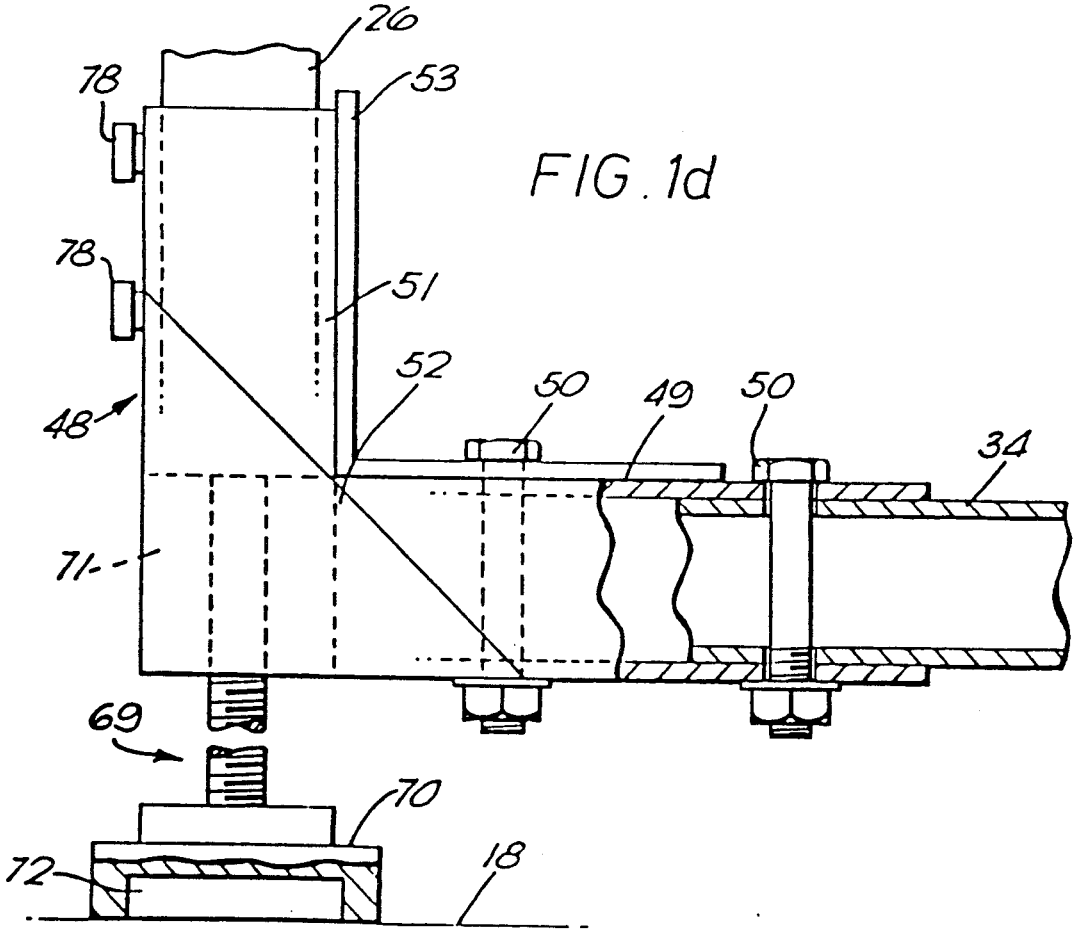

A modification to the members 48 and 62 of the appliance so far described is shown in FIG. 1E (in which parts common to those described in FIG. 1D are given the same reference numerals) This form of member 48 is of particular utility if the bed stands high off the floor 18.

This modified form of member 48 is T- rather than L-shaped—that is to say the member is provided with a depending leg section 51' coaxial with the upstanding section 51 and extending in use vertically below that section. In this arrangement the insert for the adjustable feet 69 and 73 are carried in the depending leg section 51' below the elongate members 34 and 54.

Another modified form of this embodiment of the invention is shown in FIG. 1F in which parts common to this modified form and that already described are given the same reference numerals).

In the modified embodiment of FIG. 1F the adjustable spacer members 74 have been removed and subframe 30 provided with a sixth cross member 80 welded to the upper surfaces and extending above the elongate members 34 at a location partway along the length of the elongate members between the cross members 38 and 42 as shown.

With this modified embodiment the assembly of the appliance is in substance as described before save that the second subframe is held aligned with the first subframe 30 by the additional action cross members 46 and 80 which contact the upper and lower surfaces of the the elongate members 54—when the "inner" ends of those members are passed between the ends of the elongate members 34 and the cross members 42 and 44.

It will be appreciated that the modified appliance may firmly be attached to the bed 10 and that when pressure is applied to the padded footboard the tendency for the "inner" end of the subframe 30 to lift will be resisted by the actions of bolt members 66, the stub member 74 and the cross member 80.

It will be seen that other modifications may be made to the described arrangements without departing from the scope of the invention—for example the L-section load spreading member may be replaced by a simple plate welded to the upstanding legs 51 of the members 48 (and/or the legs 65 of the members 62).

Figure 2A:
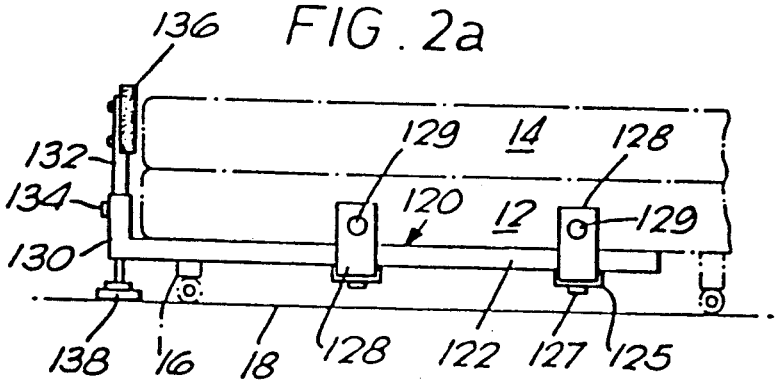
Figure 2B:
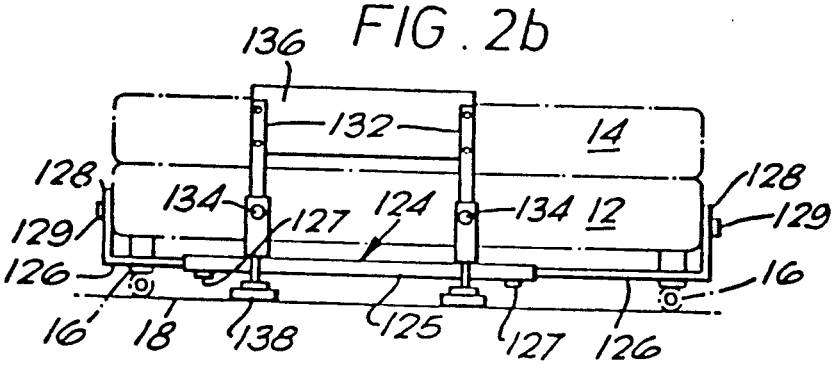
Figure 2C:
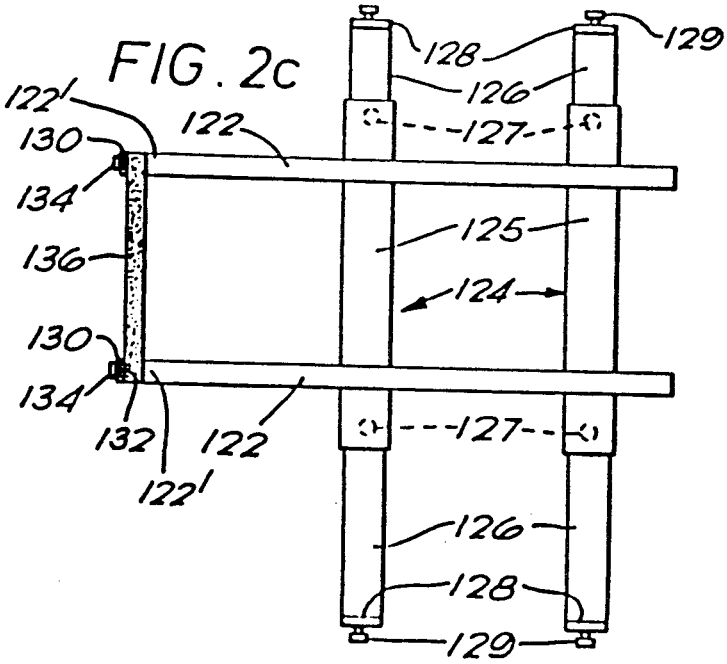

A second embodiment of the invention illustrated in FIG. 2 is shown to comprise a framework 120 formed of square section hollow mild steel members 122 running longitudinally from the foot end of the bed and square section hollow mild steel cross members 124 running transversely of bed 10. Each cross member 124 comprises a centre part 125 welded to the two members 122 as shown.

The members 124 further include end sections 126 which are of smaller size than the parts 125 and are received within those parts. The parts 126 are adjustable telescopically in the parts 125 and when correctly positioned the parts 125 and 126 may be fixed together by suitable screw clamps 127. The outermost free ends of the parts 126 support upstanding plate members 128 welded thereto. The plates 128 optionally carry threaded screw clamps 129 as shown.

The members 122 extend as shown to form end sections 122' spaced from the members 124 and passing in use from beneath the bed 10. An upstanding square section hollow mild steel member 130 is provided welded to the end of each member 122' as shown running generally vertically parallel to the foot end of bed 10. The members 130 each receive square section hollow mild steel leg members 132 of smaller size within them and the relative positions of the members 130 and 132 is adjustable telescopically. After adjustment of their relative positions the members 130 and 132 may be fixed together by operation of screw clamps 134.

The uppermost ends of the leg members 132 have running between them a padded footboard 136 as shown. Each end section 122' has, as shown, a screw threaded adjustable foot 138 at the end thereof beneath the member 130.

To fix the appliance to bed 10 the central part of the framework (the members 122 and 125) is located beneath the base 12 of the bed with the upstanding members 130 clear of the foot end of the bed. Members 126 are inserted in the ends of the members 125 to one side of the main frame and fixed together by operating the clamps 127. The partly assembled frame is propped in a position so that the plates 128 overlie one side of the base 12 of bed 10. Members 126 are then inserted into the other ends of members 125 until the plates 128 carried by them bear on the other side of the base 12 of the bed. The clamps 127 are then tightened to positively fix the framework 120 to base 12 of bed 10 clear of the floor 18 on which the bed stands. The screw clamps 129, if provided on the plates 128, are also tightened to firmly hold the framework on the bed 10.

The lower ends of the leg members 132 are then located in the upstanding members 130 and their relative positions adjusted to bring the top of the padded footboard 136 to a desired level—e.g. approximately 7.5 cm (3") above the top of the mattress 14 of the bed as shown. Finally, the screw threaded feet 138 beneath the members 130 are adjusted down until they bear on the floor 18.

It will be appreciated that the appliance formed and assembled as described enables a person to place his foot against the padded footboard 136 and to bear thereagainst when engaged in sexual intercourse.

The arrangement shown in FIG. 2 may be modified without departing from the scope of the invention by providing that the plates 128 are replaced by pairs of clamping members which may be operated to grip either side of the boards forming the sides of the base 12 of the bed. Again, the the adjustable screw feet 138 may be replaced by known overcentre spring foot members supported on the lower ends of the members and movable between positions in which they bear on the floor and lie parallel to the members 130.

It will be appreciated that with all the embodiments the relative position of the footboard of the second part may be moved across the width of the bed by suitably positioning the framework forming the first part of the appliance. It will further be appreciated that the footboards described may be smaller or larger than shown in the Figures—for example they may be selected to run the full width of the bed to which the appliance is to be attached.

The embodiment of the invention shown in FIG. 3 replaces the framework beneath the bed with one directly attachable to foot end of the base of the bed 10.

Figure 3A:
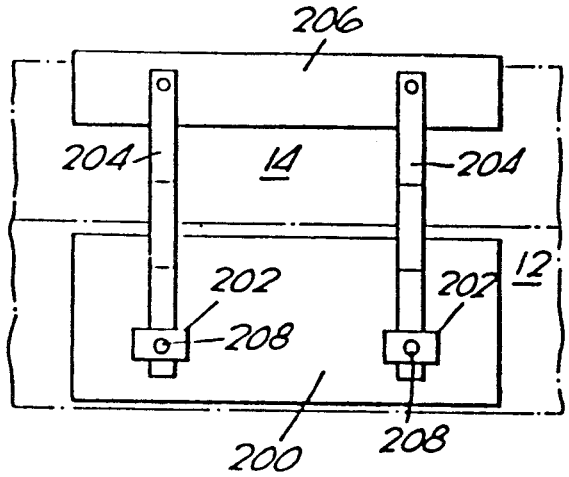
Figure 3B:
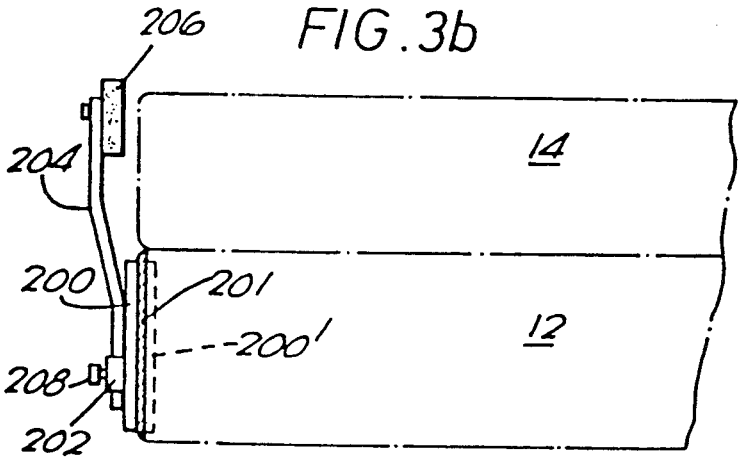

In the arrangement shown in FIGS. 3A and 3B, the appliance is show to comprise a mild steel plate 200 screwed or bolted to a board 201 in the foot end of the bed 10. To increase the rigidity of the fixture of plate 200 and additional plate 200' may be provided within the bed, as shown in dotted outline. Plate 200 has on its outermost surface two C- or U- shaped mild steel straps 202 welded thereto each of which receives a leg member 204 of the second part of the appliance. The uppermost ends of the members 204 carry and are linked together by a padded footboard 206. The height of the footboard 206 may be adjusted relative to the top of the mattress 14 on the bed 10 by movement of the members 204 in the straps 202, once the desired height—approximately 7.5 cm (3") above the top of the mattress—has been attained the members being locked in position by operation of screw clamps 208 associated with each strap 202.

The arrangement shown in FIGS. 3A and 3B may varied without departing from the scope of the invention; for example the members 204 may be rigidly fixed to the plate 200 and telescopically adjustable in height in the manner described with reference to the parts 130 and 132 shown in FIG. 2.

The size of the plate 200 may, of course, varied—for example, it is of particular advantage with modern "sprung sided" beds in which the sides and ends of the base of the bed are not solid over the whole of its height to use a plate 200 which is less tall than that shown in FIG. 3A—in particular to use a plate 200 the height of which is substantially the same as that of any boarding in the the sides and ends of the base of the bed.

Figure 3C:
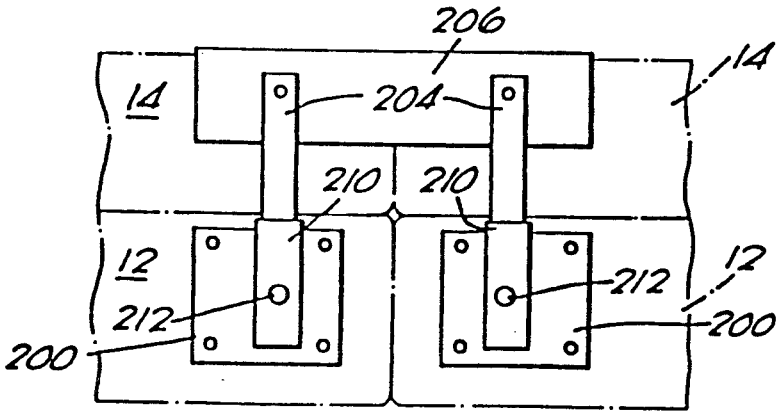

Another variation of this embodiment is shown in FIG. 3C in which two plates 200 have been used, each supporting one member 204,—this arrangement is of particular utility for use with divided beds (as shown) in which the two halves of the bed 10 are separable. Each of the plates 200 has welded to its outer surface a square section socket 210 which receives a leg 204 and the leg may be fixed in a desired position by use off a screw clamp member 208 as shown.

It will be appreciated that various other modifications may be made to the arrangements described above without departing from the scope of the present invention e.g. the materials used to form the embodiments of the appliances described may be varied—the mild steel may be replaced by any suitable metal (for example aluminium) or other material (for example high strength plastics materials) with sufficient strength. Again, the means of fixing the various parts together may differ from that described (for example rather than welding the parts together they may be glued, bolted, screwed of fixed together in any suitable way).

For example in the arrangements of FIGS. 1 and 2 the faces of the elements bearing on the sides or ends of the bed base may if desired be provided with a non-slip (e.g. rubberised) surface to ensure the appliance remains attached to the bed base whilst the bed base is being turned right side up.

Again the surfaces of the adjustable feet contacting the floor may if desired be provided with nonslip coating if the bed is to be used on a smooth (noncarpeted) floor.

It will further be seen that parts of the arrangements described with reference to ones of the Figures may be combined with parts of the arrangements shown in the other Figures. Again, the elements of the appliance described as being of square hollow section may be of any desired cross section (round, squares, triangular) or of other suitable configuration. The elements are shown to be generally linear, however, they may take other forms if thought desirable and/or necessary.

Again, it will be appreciated that the dimensions of the first and second parts need not be limited to those shown, the footboard may, if desired, extend the full width of the bed and, as noted, its height may be varied (above or below the level of the mattress) as desired by a user.

Finally, it will be appreciated that the particular implementations shown are merely examples of ways of effecting the invention and that other equivalent and suitable means may be provided—e.g. the various bolts and screw clamp elements shown may be replaced with any other suitable desired form of releasably joining elements together.

INDUSTRIAL APPLICABILITY

It will be seen that all the embodiments described are usable with the majority of beds sold presently being made and sold, that is to say e.g. "divan" style beds, not having a solid footboard against which the foot of a person engaged in sexual intercourse on the bed may bear.

It will be seen that appliances described are adjustable to adapt to different widths and bed heights, and to adapt to beds which stand at different heights above a floor on which they stand; that the appliances described will not normally be visible to a casual observer as the parts of them will lie beneath clothing on the bed, e.g. 5 quilts, bedspreads, and valences on the mattress and base of the bed; and that the appliances described can be left in position or, if desired, be readily removed disassembled and stored.

I claim:

1. An appliance for use with a bed having a base part supporting a mattress to aid couples having sexual intercourse on the bed, the appliance comprising a first part releasably fixable to the base of the bed, a footboard having leg members depending therefrom which are receivable in the first part wherein the relative positions of the first part and leg members of the footboard is adjustable to enable the height of the footboard to be varied so that the upper edge of the footboard may be located substantially adjacent the upper surface of a mattress on the bed so that the foot of a person on the bed mattress may bear against it, wherein said first part comprises a framework formed from two or more elements in use located beneath and releasably fixable to the bed and which act to clamp the bed therebetween the framework having means for bearing in use upon a floor upon which the bed stands.

2. An appliance as claimed in claim 1, wherein, the relative positions of the elements forming the framework are adjustable and have means enabling them to be fixed in their adjusted positions so that the appliance may be clamped to beds of different widths and/or lengths.

3. An appliance as claimed in claim 2, wherein the framework is provided with means for bearing upon a floor upon which a bed to which the appliance is attached stands, said means being adjustable in height so that the appliance may be adapted for use with beds the bases of which stand at different heights above a floor on which they are located.

4. An appliance as claimed in claim 2, wherein said framework includes a pair of elongate members supported in parallel one with the other and spaced apart by a number of cross members, first ends of the elongate members carrying upstanding members which in use overlie a lower part of the foot end of a bed to which the appliance is to be attached and which are adapted to receive leg members of the said second part of the appliance and have adjustable feet the height of which may be varied, wherein each cross member comprises a centre part attached to each of the elongate members and end sections of smaller diameter than the said centre part which are received within the centre part such that the positions of the end sections relative to the centre sections are adjustable telescopically, wherein fixing means are provided enabling the end sections and centre parts to be releasably fixed together after their relative positions have been adjusted such that the outermost ends of the cross members are aligned with the sides of the bed, and wherein each cross member carries at its outermost end means enabling the framework to be releasably clamped to the sides of the bed to which the appliance is to be attached.

5. An appliance as claimed in claim 4, wherein the outermost end of each end part of each cross member carries and upstanding plate members which overlie a lower part of a bed with which the appliance is to be used, and which is used to clamp the framework to the bed by adjustment of the relative positions of the centre parts and sections of smaller diameter and the fixing means.

6. An appliance as claimed in claim 4, wherein the outermost end of each end part of each cross member carries an upstanding clamp member which may be arranged to grip and clamp onto either side of boards forming the sides of the base of the bed.

7. An appliance as claimed in claim 1, wherein the framework comprises two subframes, each including a pair of elongate members supported in parallel one with the other and spaced apart by cross members, first ends of the elongate members of the said two subframes being provided with upstanding members which in use overlie a lower part of a bed to which the appliance is to be attached; at least one bolt member interconnecting cross members of the two subframes and which is adjustable in length to move the two subframes relative to one another to a position in which the said upstanding members of the said two subframes bear against said lower part of a bed with which the appliance is to be used so as to clamp the appliance to the bed, and wherein the upstanding members of one said subframe are further adapted to receive said leg members of the said second part of the appliance and have feet the height of which may be adjusted to bear upon a floor upon which in use the bed to which the appliance is attached stands.

8. An appliance as claimed in claim 7, wherein the spacing of the elongate members of the said two subframes is such that second ends of the elongate members of one said subframe lie in the plane of said between second ends of the elongate members of the other said subframe and between a pair of cross members attached thereto.

9. An appliance as claimed in claim 7, wherein the first ends of the elongate members of the said other subframe have feet the height of which may be adjusted to bear upon a floor upon which in use the bed to which the appliance is attached stands.

10. An appliance as claimed in claim 7, wherein the said said second ends of the elongate members of the one or other of the said subframes carry adjustable spacer members which may be adjusted to bear against an undersurface of a bed to which the appliance is attached.

11. An appliance as claimed in claim 7, wherein the elements of the framework are welded together.

12. An appliance as claimed in claim 7, wherein the elongate members and the cross members are of metal and of hollow square section, wherein the elongate members of the first subframe are supported parallel and spaced apart by a first and second cross members attached to and extending between facing surfaces of the elongate members adjacent the said first ends thereof and partway along their lengths, third and fourth cross members attached to upper and lower surfaces of and extending above above and below the elongate members at the said second ends thereof and a fifth cross member attached to and extending between facing surfaces of the elongate members at a location partway along their lengths, wherein the elongate members of the second subframe are supported parallel and spaced apart by a first cross member attached to and extending between facing surfaces of the elongate elongate members adjacent the said second ends thereof and by a second cross member attached to and extending cross the said first ends thereof, and wherein a pair of bolt members are provided coupling the said second cross member of the first subframe and the said second cross member of the second subframe.

13. An appliance as claimed in claim 12, wherein the first subframe is provided with a further cross member attached to upper surfaces of and extending above the elongate members at a location partway along the length of the elongate members between the said second and third cross members thereof.

14. An appliance as claimed in claim 12, wherein the elements of the framework are welded together.

15. An appliance for use with the bed having a base part supporting a mattress, to aid couples having sexual intercourse on the bed, the appliance comprising a first part releasably fixable to the base of the bed, a footboard having leg members depending therefrom which are receivable in the first part, wherein the relative positions of the first part and leg members of the footboard are adjustable to enable the height of the footboard to be varied so that the upper edge of the footboard may be located substantially adjacent the upper surface of the mattress on the bed so that the foot of a person on the bed mattress may bear against it, said first part comprising metal plate fixable to the outer surface of the foot end of the base of the bed and having welded on its outermost surface two or more hollow metal parts each of which receives a leg member of the footboard, and includes clamp means being provided on said hollow metal parts to enable fixture of the leg members when the footboard has been positioned at a desired height.

16. An appliance as claimed in claim 15, wherein the first part further comprises a second metal plate mounted on the inner surface of the foot end of the base of the bed in register with and fixable to said first metal plate, such that the pair of metal plates act to clamp the foot end of the base of the bed therebetween.

17. An appliance for use with a bed, the base of which is in two separable sections each supporting a mattress to aid couples having sexual intercourse on the bed, the appliance comprising a first part releasably fixable to the base sections of the bed, a footboard having leg members depending therefrom which are receivable in the first part, wherein the relative positions of the first part and leg members of the footboard to be varied so that the upper edge of the footboard may be located substantially adjacent the upper surface of the mattress on the bed so that the foot of a person on the bed mattress may bear against it, wherein the first part comprises two metal plates respectively fixable on the outer surfaces of the foot end of the base of each section of the bed and having welded on its outermost surface a hollow metal part which receives leg members of said footboard, clamp means being provided on each of said hollow metal parts to enable fixture of the leg members and the footboard has been positioned at a desired height.

18. An appliance as claimed in claim 17, wherein said first part further comprises a second metal plate mounted on an inner surface of the foot end of each section of the base of the bed, said second metal plates being respectively in register with and fixable to said first metal plates such that each pair of metal plates acts to clamp the foot end of the section of the base of the bed with which they are associated therebetween.

* * * * *